United States Patent [19]

Miyamoto

[11] Patent Number: 5,013,343

[45] Date of Patent: May 7, 1991

[54] DUST COLLECTOR

[75] Inventor: Kouichi Miyamoto, Hiroshima, Japan

[73] Assignee: Ryobi, Ltd., Hiroshima, Japan

[21] Appl. No.: 54,917

[22] Filed: May 28, 1987

[30] Foreign Application Priority Data

May 28, 1986 [JP] Japan ..... 61-124308

[51] Int. Cl.[5] ..... B01D 29/94

[52] U.S. Cl. ..... 55/395; 55/429; 55/430; 55/432

[58] Field of Search ..... 55/213, 215, 395, 429, 55/430, 432, 433

[56] References Cited

U.S. PATENT DOCUMENTS

| | | | |
|---|---|---|---|
| 540,720 | 6/1895 | Clark | 55/430 X |
| 823,463 | 6/1906 | Deneen | 55/430 X |
| 1,239,456 | 9/1917 | Brantingham et al. | 55/430 X |
| 1,355,293 | 10/1920 | Watkins | 55/430 X |
| 1,781,430 | 11/1930 | Blaney | 55/287 |
| 1,782,540 | 11/1930 | Machtolf | 55/430 X |
| 1,886,548 | 11/1932 | Horne et al. | 55/430 X |
| 2,098,024 | 11/1937 | Bailey | 55/430 X |
| 2,115,326 | 4/1938 | Bowen | 55/433 |
| 2,633,206 | 3/1953 | Bruckner | 55/213 |
| 3,609,944 | 10/1971 | Wildbolz et al. | 55/215 |
| 3,877,899 | 4/1975 | Bundy et al. | 55/429 X |
| 3,909,222 | 9/1975 | Caughlin et al. | 55/432 X |
| 4,180,390 | 12/1979 | Furstenberg | 55/429 X |
| 4,350,499 | 9/1982 | Lundgren | 55/432 X |
| 4,490,162 | 12/1984 | Davis | 55/213 |
| 4,655,806 | 4/1987 | Bowersox | 55/432 X |

FOREIGN PATENT DOCUMENTS 43358 9/1983 Japan .

*Primary Examiner*—Robert Spitzer

*Attorney, Agent, or Firm*—Sughrue, Mion, Zinn, Macpeak & Seas

[57] ABSTRACT

In a dust collector, dust and waste materials such as wood chips and shavings are collected in its casing through a dust collecting duct by a dust collecting fan rotated by a motor. The dust and waste materials thus collected are compressed and extruded by an extruding screw which is rotated by the motor, whereby the dust and waste materials can be readily discarded.

5 Claims, 3 Drawing Sheets

DUST COLLECTOR

BACKGROUND OF THE INVENTION

1. Field of the Invention

This invention relates to small portable dust collector.

2. Background of the Invention

A conventional dust collector is so designed as to collect dust or waste materials in a dust collecting chamber provided inside a machine. Therefore, the maximum amount of dust which can be collected thereby is limited. Especially in the case of collecting waste materials such as wood chips or shavings formed during woodworking, which are relatively bulky and loose, the dust collecting chamber is quickly filled up with the waste materials, and therefore it must be emptied frequently. This process of discharging the waste material is rather troublesome.

Japanese Utility Model Application (OPI) No. 4358/1983 has disclosed a dust collector which is so designed that two bags are provided for receiving dust from a dust sucking section, and, when one of the two bags is filled up with dust, a damper is operated to allow the other bag to receive the dust.

The conventional dust collector thus designed is advantageous in that the bag filled up with dust can be replaced by a new one without stopping the dust collector. However, it is still disadvantageous in the following points. In the case of collecting waste materials such as wood chips or shavings, the bag is soon filled up with them. That is, the frequency of exchanging the bag is relatively high. Furthermore, the replacement of the bag is troublesome, a number of bags must be prepared, or special bags must be designed for the dust collector. Moreover, since dust and waste materials are collected together with air, the dust and waste materials thus collected is bulky in the bag, thus taking time and labor for removal and disposal.

SUMMARY OF THE INVENTION

Accordingly, an object of this invention is to eliminate the above-described difficulties accompanying a conventional dust collector.

More specifically, an object of the invention is to provide a small-sized dust collector in which, even when waste materials such as wood chips or shavings formed in woodwork are collected in a bag, the frequency of replacing the bag is low, the collected dust and waste materials can be readily removed and discarded, and no special bags are used.

The foregoing object and other objects of the invention have been achieved by the provision of a dust collector which, according to the invention, comprises: a dust collector casing connected to a dust collecting duct; an electric motor for rotating a dust collecting fan to suck dust and waste materials into the dust collector casing; and a dust discharging section having an extruding screw which is rotated by the motor to compress in an extruding space the dust and waste material thus sucked and to discharge the dust and waste materials thus compressed.

DETAILED DESCRIPTION OF THE PREFERRED EMBODIMENT

Figure 1:
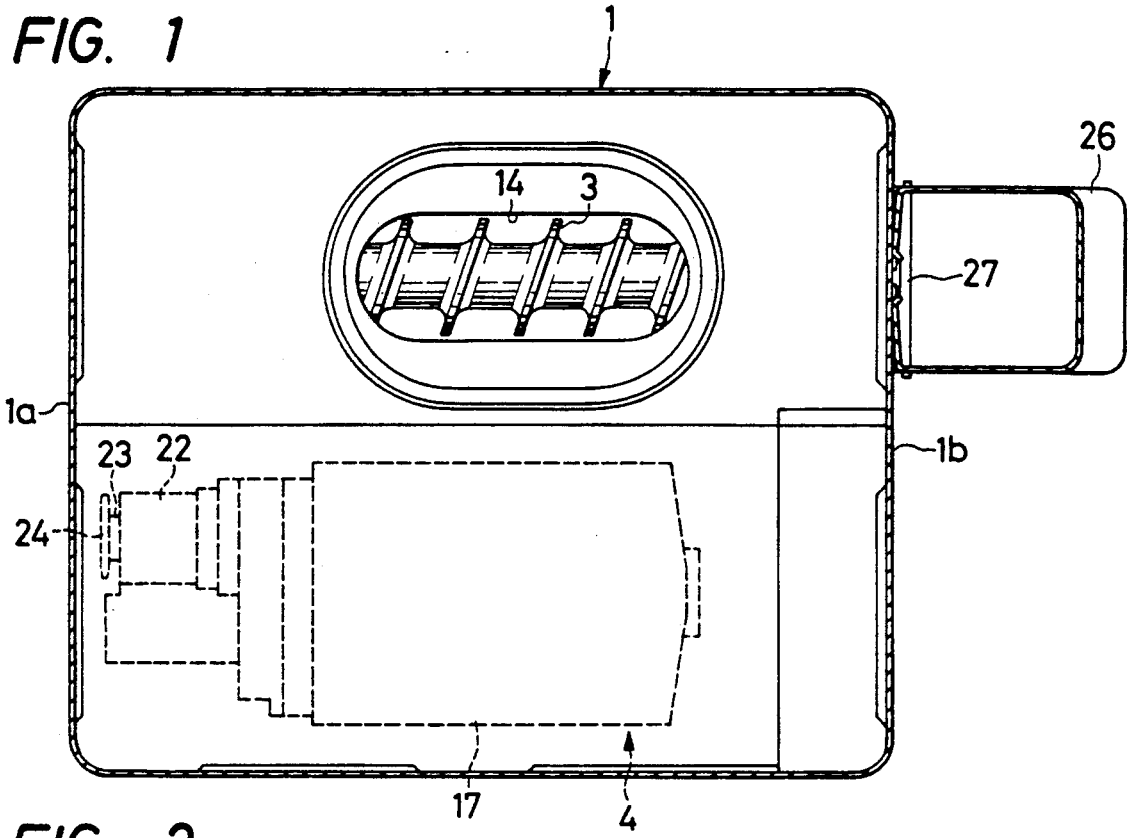
FIG. 1 is a horizontal sectional view showing one example of a dust collector according to this invention.

The nature, principle and utility of the invention will become more apparent from the following detailed description when read in conjunction with the accompanying drawings, in which like parts are designated by like reference numerals.

A dust collector according to this invention, as shown in FIGS. 1 through 5, includes a dust collector casing 1 which is substantially the body of the dust collector. A dust discharging section 2 with an extruding screw 3, shown in FIG. 4, compresses and discharges dust and waste materials such as wood chips and wood shavings. A motor section 4, shown in FIG. 2, includes a dust collecting fan 5. These dust collecting and motor sections 2 and 4 are built in the lower portion of the casing 1. A lid 6, shown in FIGS. 2 and 3, has a recess 6*a*, the bottom of which is partially extended downwardly, thus forming a substantially cylindrical part 7 which is connected to a dust collecting duct 9. The recess 6*a* is inserted into the casing 1 so that the upper portion of the casing 1 is sealably closed by the lid 6. The lid 6 thus fitted in the casing 1 is sealably closed by a cover 8, which is penetrated by the dust collecting duct 9 whose lower end is connected to the cylindrical part 7 as was described above. The cylindrical part 7 has an opening 7*a* at the lower end which is connected to the dust collecting duct 9 and is located near the dust discharging section 2.

Figure 2:
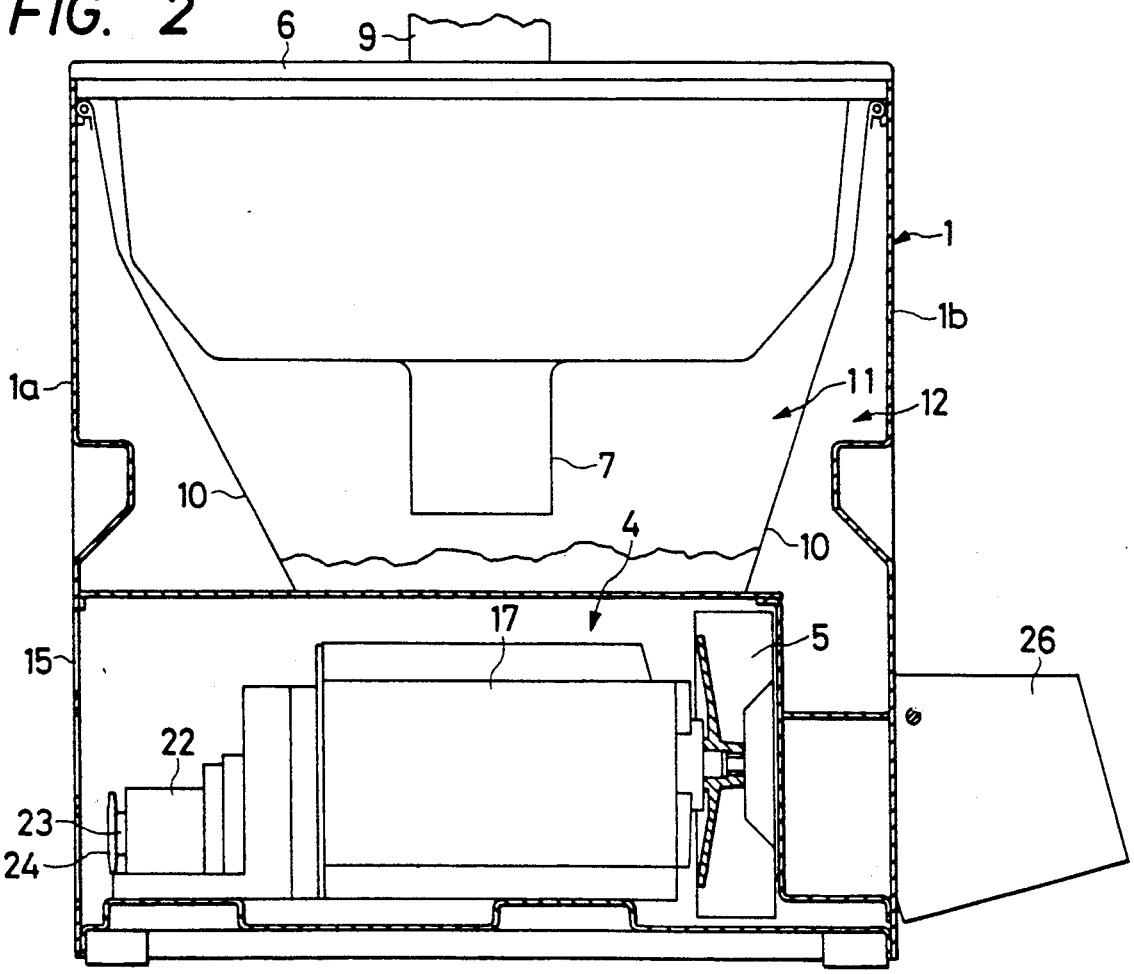
FIG. 2 is a vertical sectional view of the dust collector shown in FIG. 1.
Figure 3:
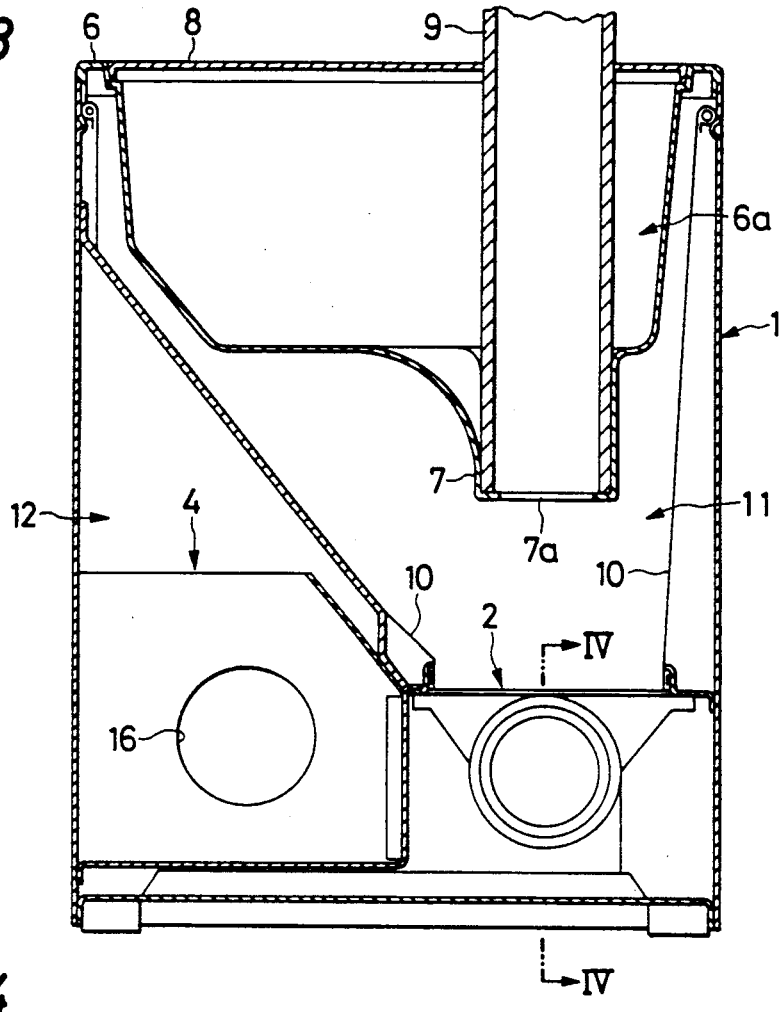
FIG. 3 is a sectional side elevation of the dust collector shown in FIGS. 1 and 2.

A filter 10, shown in FIGS. 2 and 3, is stretched tight inside the dust collector casing 1 in such a manner that it divides the space in the casing into an upper space 11 and a lower space 12. In the upper space 11, the dust collecting duct 9 communicates with the dust discharging section 2 through an opening 14 (FIGS. 1 and 4) formed in a screw casing 13 of the dust discharging section 2. In the lower space 12, the above-described dust collecting fan 5, a number of air discharging holes 15 (FIGS. 2 and 5) formed in side walls 1*a* and 1*c* of the casing 1, and an air sucking hole 16 (FIG. 3) communicate with one another. Therefore, as the dust collecting fan 5 is rotated by the motor 17, the air in the lower space 12 is sucked out through the air sucking hole 16 and then discharged to the outside through the air discharging holes 15 so that the pressure in the upper space 11 is decreased. As a result, dust and waste materials together with the air are sucked into the upper space 11 through the dust collecting duct 9 from outside. Different types of standard implements and hoses may be used for initially collecting the dust. The dust and waste materials thus sucked are brought into the dust discharging section 2, while the air thus sucked is discharged through the air discharging holes 15 by the dust collecting fan 5.

Figure 4:
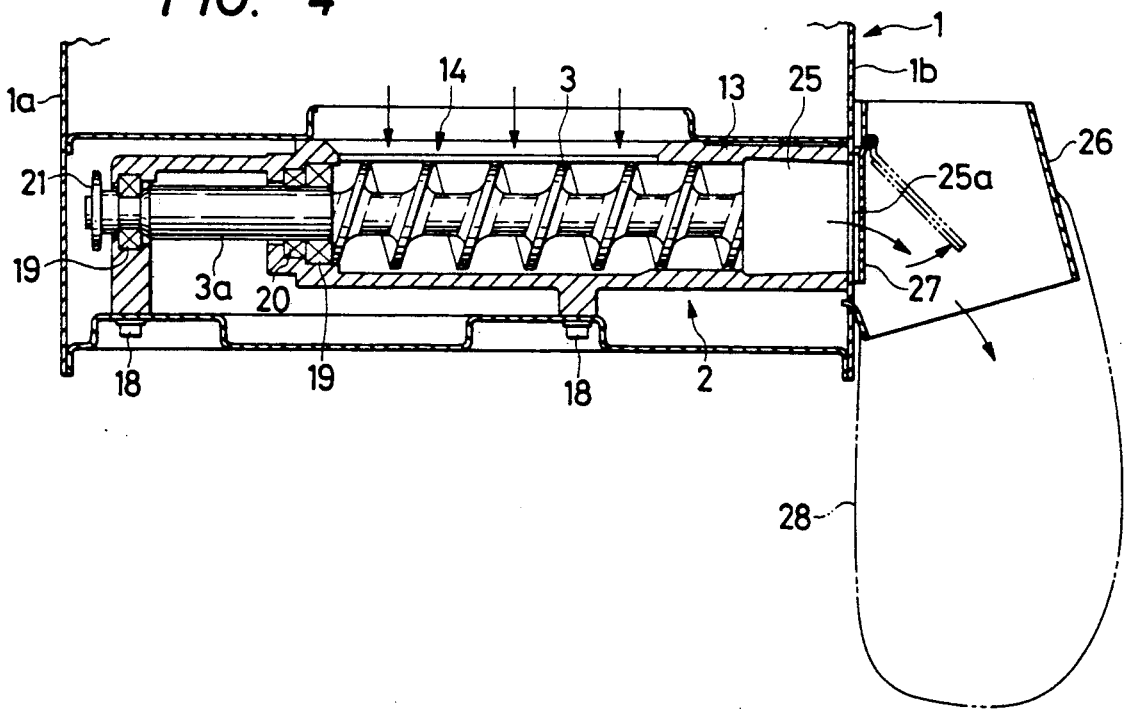
FIG. 4 is a sectional view taken along line IV—IV in FIG. 3.
Figure 5:
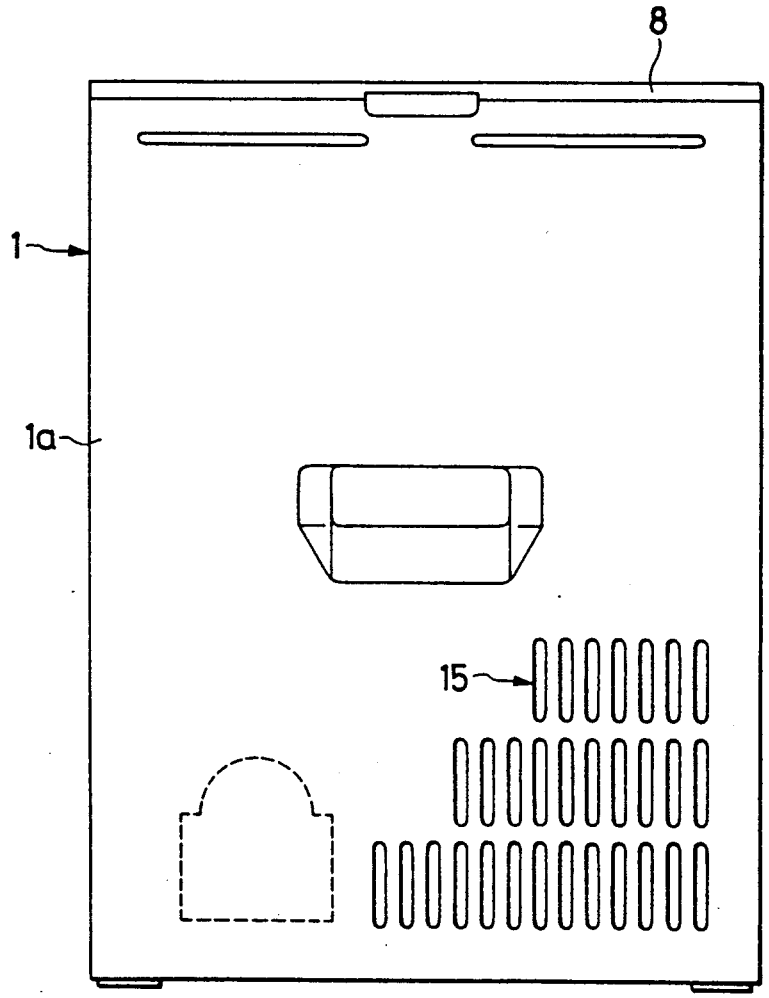
FIG. 5 is a diagram showing the left side wall of the dust collector.

The construction of the air discharging section 2 will be described with reference to FIG. 4 in more detail.

The screw casing 13 is fixedly installed in the dust collecting casing 1 with bolts 18 in such a manner that it extends longitudinally. The aforementioned extruding screw 3 is rotatably supported in the screw casing 13 by means of a radial bearing 19 and a thrust bearing 20. A chain (not shown) is laid over a sprocket 21 fixedly mounted on the shank 3*a* of the screw 3 and also over another sprocket 24 (FIG. 1 or 2) fixedly mounted on the drive shaft 23 of a reduction gear mechanism 22 which is coupled to the output shaft (not shown) of the motor 17. Thereby, the extruding screw 3 is rotated at a suitable speed by the motor 17.

In the other end portion of the screw casing 13, an extruding space 25 is provided in front of the end o the extruding screw 3 in such a manner that the space 25 communicates with: the outside through an opening 25*a* which is formed in a side wall lb of the dust collector casing 1.

A dust guide 26 is fixedly mounted on the side wall lb in such a manner that the dust guide 26 covers the opening 25*a*. A dust cover 27 is hinged with the dust guide 26 in such a manner that the dust cover 27 can open and close the opening 25*a* of the extruding space 25. Normally, the dust cover 27 closes the opening 25*a* under its own weight or perhaps by use of a spring (not shown). The dust and waste materials compressed by the extruding screw 3 are collected into a bag 28.

The dust collector thus constructed operates as follows. First, the motor 17 is operated to rotate the dust collecting fan 5 and the extruding screw 3. Therefore, the air in the lower space 12 is sucked through the air sucking hole 16 and discharged outside through the air discharging holes 15 so that the pressure in the upper space 11 is reduced. Accordingly, the dust and waste materials and air in the dust collecting duct 9 are sucked into the upper space 11. In this operation, the air is led into the lower space 12 through the filter 10 and discharged through the air discharging holes 15 from the lower space 12 by the dust collecting fan 5. That is, only the dust and waste materials fall through the opening 14 into the screw casing 13. The dust and waste materials thus led into the screw casing 13 are extruded by the extruding screw 3 to the right (in FIG. 4) into the extruding space 25. In this operation, the opening 25*a* of the extruding space 25 is kept closed by the dust cover 27 as was described above. Therefore, the dust and waste materials being moved towards the opening thus closed are compressed in the extruding space 25. This compression pressure opens the dust cover 27, so that the dust and waste materials thus compressed are discharged through the opening 25*a* into the dust guide 26. If, in this case, the bag 28 is connected to the dust guide 26 as shown in FIG. 4, then the dust and waste materials are allowed to drop into the bag 28.

In this operation, the extruding space 25 is closed by either the closed dust cover 27 or by the compressed dust and waste materials. Therefore, no air is pumped back through the opening 25*a*. Accordingly, only the dust and waste materials compressed are discharged into the bag 28. Any kind of bag may be used as the bag 28.

As was described above, in the dust collector of the invention, dust and waste materials are collected in the dust collector casing 1 by the dust collecting fan 5 and compressed in the extruding space 25 by the extruding screw 3 of the dust discharging section 2. The dust and waste materials thus compressed are discharged outside through the dust guide 26. Therefore, even waste materials such as wood chips or shavings formed in woodworking which are relatively bulky and loose can be compressed into a small block which is allowed to drop into the bag 28. It goes without saying that the waste materials in the bag can be readily handled or dealt with. Furthermore, any kind of bag may be used to receive the dust and waste materials compressed in the extruding space, as was described above. Since the dust and waste materials are compressed, the frequency of replacing the bag is reduced as much. In the dust collector of the invention, dust and waste materials are collected outside the dust collector casing 1, and therefore the dust collector can be miniaturized as much.

What is claimed is:

1. A dust collector comprising:

a dust collector casing connected to a dust collecting duct;

an electric motor for rotating a dust collecting fan to suck dust and waste material into said dust collector casing; and a dust discharging section having dust compressing means comprising an extruding screw having an inlet end and an outlet end, and an extruding space having one end communicating with said outlet end of said extruding screw and an opposite end communicating with a discharge opening, said extruding screw being rotated by said motor to compress without stirring in said extruding space said sucked dust and waste materials and to discharge said compressed dust and waste material from said dust discharging section through said discharge opening, said dust discharging section further comprising a screw casing defining a screw space for accommodating said extruding screw, said screw space communicating with an innerspace, said extruding space forming a separate and distinct compression chamber located between said outlet end of said extruding screw and said discharge opening, wherein said dust compressing means further comprises a normally closed dust cover disposed at said opposite end of said extruding space so as to close said discharge opening and which is openable in an outward direction by said compressed dust and waste materials in said extruding space.

2. A dust collector as recited in claim 1, further comprising:

a filter separating said inner space communicating with said dust collecting dust from an outer space communicated with said dust collecting fan.

3. A dust collector as recited in claim 2, wherein said dust cover is a hinged cover, said hinged cover being spring biased in the closing direction.

4. A dust collector as recited in claim 3, further comprising gear reduction means coupling said motor to said extruding screw.

5. A dust collector as recited in claim 3, further comprising a dust guide fixedly mounted to said dust collector casing so as to surround said discharge opening, said hinged cover being hinged to said dust guide.

* * * * *